US006431694B1

(12) United States Patent
Ross

(10) Patent No.: US 6,431,694 B1
(45) Date of Patent: Aug. 13, 2002

(54) PUMP FOR RECIRCULATING INK TO OFF-AXIS INKJET PRINTHEADS

(75) Inventor: Graham Ross, Poway, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/841,914

(22) Filed: Apr. 24, 2001

(51) Int. Cl.[7] ..... B41J 2/175

(52) U.S. Cl. ..... 347/85; 417/77; 347/89

(58) Field of Search ..... 347/30, 85, 89; 417/77, 93, 97, 103, 137

(56) References Cited

U.S. PATENT DOCUMENTS 4,558,326 A * 12/1985 Kimura et al. ..... 347/30
4,929,963 A * 5/1990 Balazar ..... 347/89

* cited by examiner

*Primary Examiner*—Anh T. N. Vo

(57) ABSTRACT

Embodiments of the present invention comprise fluid pumps having two expandable chambers, with each chamber having a fluid inlet and a fluid outlet. Each chamber further has a pressurizing wall causing the chamber to expand or contract, thus drawing fluid into the chamber or expelling it from the chamber. The pressurizing walls of the two chambers are in mechanical communication, such that when one chamber is expanding, the other chamber is compressing. Multiple check valves prevent retrograde motion of the ink through the pump.

11 Claims, 7 Drawing Sheets

510
512
542
193
194
150
120
130
192
191
520
532
522
538
536
534
530

PUMP FOR RECIRCULATING INK TO OFF-AXIS INKJET PRINTHEADS

BACKGROUND OF THE INVENTION

The present invention relates generally to ink-jet technology and, more specifically, to a pump for circulating ink in an off axis ink delivery system.

The art of inkjet technology is well developed. Commercial products such as computer printers, graphics plotters, and facsimile machines employ inkjet technology for producing hard copy. The basics of this technology are disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions.

Basically, it is known in thermal inkjet printing to provide a printhead having an orifice plate in combination with heating elements. Thermal excitation of ink is used to eject droplets through tiny nozzles, or orifices, onto a print media. Dot matrix manipulation of the droplets provides alphanumeric character and graphics printing capabilities. Other ink-jetting mechanisms, such as by the use of piezoelectric transducers or wave propagation as ink droplet generators, are also well developed in the art.

In the most common type of inkjet printer, the printheads are mounted on a scanning carriage which moves back and forth over the print media, printing a swath of text or graphics during each pass over the media. At the end of each sweep over the media, the media is advanced, and the carriage reverses direction. The carriage then scans back across the media in the reverse direction, printing a second swath of text or graphics.

The inkjet pen itself may have a self-contained reservoir for storing ink and providing appropriate amounts of ink to the printhead during a printing cycle. These self-contained pens are also referred to in the art as print cartridges.

If a reusable pen rather than a print cartridge is employed in the hard copy apparatus, ink is generally supplied from a remote, off-axis (or off-board), ink reservoir to a relatively permanent pen body and printhead mechanism. Early inkjet printers used off-axis reservoirs as demonstrated in U.S. Pat. No. 4,312,007 ((Winfield) assigned to the common assignee of the present invention). Moreover, it has been found that for some hard copy applications, such as large format plotting of engineering drawings and the like, there is a requirement for the use of much larger volumes of ink than can be contained within a reasonably sized, replaceable, print cartridge. Therefore, improved, relatively large, off-pen ink reservoir systems have also been developed. Examples are U.S. Pat. No. 4,831,389 (Chan) which shows a multicolor off-board ink supply system, and U.S. Pat. No. 4,929,963 (Balazar) which demonstrates an ink delivery system for an ink-jet printer using a low pressure recirculating pumping system (both assigned to the common assignee of the present invention).

With both print cartridges and off-axis ink supply systems, it is common for the ink supply to be maintained at a slight negative pressure relative to ambient to prevent "drool" of ink from the printheads. It is also common to provide mechanisms to prevent or remove air bubbles and particulate contaminants from the ink, since bubbles and contaminants which find their way into the printheads can cause print quality degradation or, if the air bubbles interfere with cooling of the "firing" resistors, failure of the printhead.

One method commonly used with off-axis ink delivery systems for both insuring the removal of air bubbles and contaminants from the ink and for cooling the printhead is to circulate ink in a path from the supply, through a filter media, through the printhead, and then back to the supply. The continual movement of ink through the printhead prevents the accumulation of air bubbles and the build-up of contaminants in the printhead.

One drawback of ink recirculation systems is that pressure variations in the ink supply or return lines to an inkjet printhead can adversely affect print quality. Current pumps used for ink recirculation, either pressure or suction, either have oscillations in their output induced by the cyclic motion of the pumping components or have a constant pressure but a limited total volume (typical of syringe pumps). Pressure variations will be transmitted to the printhead and result in variations in backpressure, which can result in visual degradation of the printed image.

There is thus a need for pump designs which provide relatively constant pressure during the carriage scan time, and which are compact and simple to manufacture.

SUMMARY OF THE INVENTION

Embodiments of the present invention comprise fluid pumps having two expandable chambers, with each chamber having a fluid inlet and a fluid outlet. Each chamber further has a pressurizing wall causing the chamber to expand or contract, thus drawing fluid into the chamber or expelling it from the chamber. The pressurizing walls of the two chambers are in mechanical communication, such that when one chamber is expanding, the other chamber is compressing. Multiple check valves prevent retrograde motion of the ink through the pump.

In an ink recirculation system for a printer having a scanning carriage, embodiments of the present invention take advantage of the turn-around time between print swaths of the carriage to synchronously reverse the driving force on the pump, thus allowing a pump having a relatively small chamber volumes to provide substantially constant pressure during each print swath.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

The pump of the present invention works with current implementations of positively-pressurized ink supply recirculation systems to return ink from an inkjet printhead to the ink supply. The pump of the present invention provides a constant negative pressure (suction pressure) in the ink return line from the pen during the print swath. The preferred embodiment of the pump contains two pump chambers that are similar to syringe pumps; the two chambers are mechanically coupled together and interconnected with fluid lines and check valves so that there is suction applied to the return line regardless of which element is pumping. The pumping direction reverses during the printhead turn-around at the end of each swath to preclude suction pressure variation during the print swath.

The pump of the present invention combines the advantages of a syringe pump with the unlimited pumping capacity of oscillatory pumps. It takes advantage of the turnaround time at the end of each swath to reduce the pump element volume and the overall size of the pump without compromising the steady pressure performance during the swath.

Figure 1:
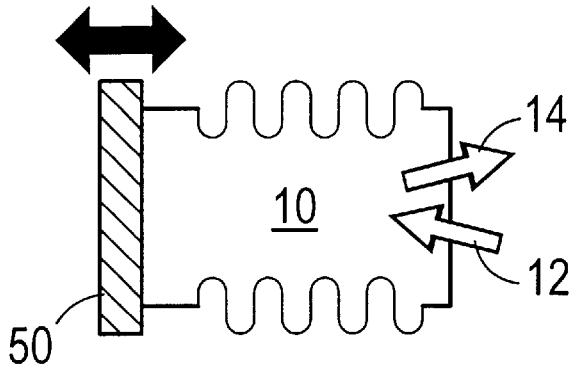
Fig. 1 (Prior Art)
FIG. 1 is a schematic representation of a prior art syringe pump.

FIG. 1 schematically depicts a typical prior art syringe pump. The syringe pump has an expandable chamber 10, denoted in FIG. 1 as having a bellows for expansion; the expandable chamber could also be formed of a piston sliding in a cylindrical chamber. A forcing member 50 applies force to either draw a fluid 12 into the chamber by causing the chamber to expend, or to force fluid 14 out of the chamber by causing the chamber to contract. The fluid inlet 12 and outlet 14 may share a common opening to the expandable chamber, or may be separate openings. Check valves (not shown) may be used to control the direction of fluid flow, such that fluid only enters through the inlet and exits through the outlet.

Figure 2:
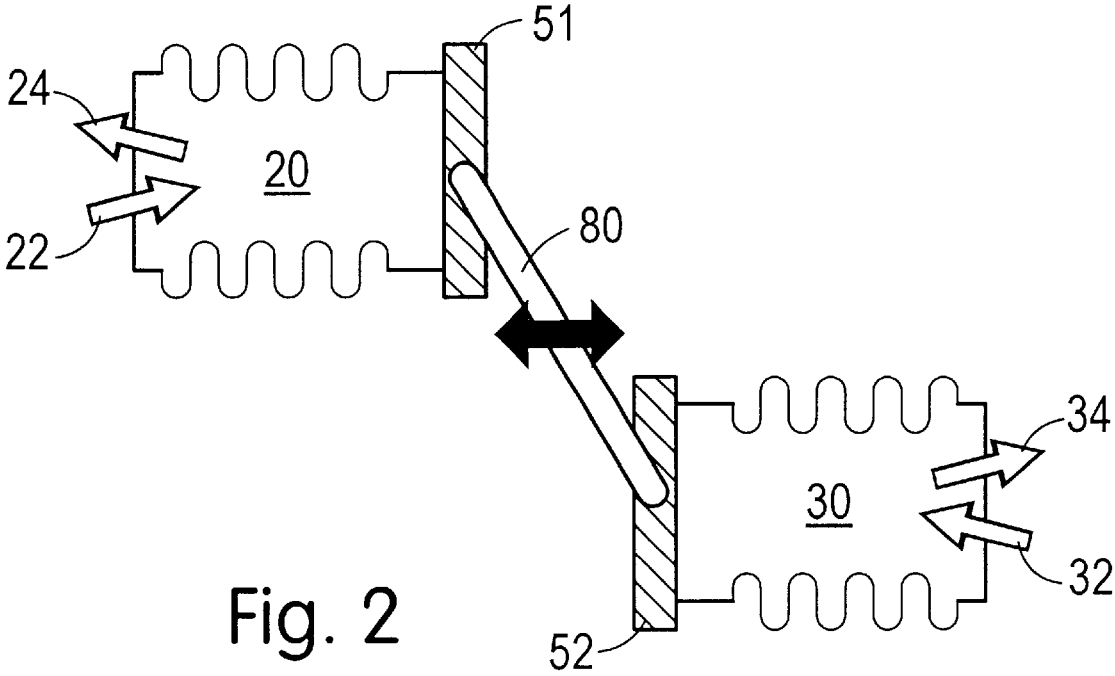
FIG. 2 is a schematic representation of the pump of the present invention.

FIG. 2 schematically illustrates the basic pump configuration of the present invention. The pump has two expandable chambers 20 and 30, each of which is comparable in function to the single expandable chamber of FIG. 1. The expanding chambers may comprise bellows, syringe pumps, or any other positive displacement mechanism known in the art. Each of the expandable chambers has a fluid inlet 22, 32; a fluid outlet 24, 34; and a forcing member 51, 52. The present invention contemplates a mechanical linkage 80 between the two forcing members, such that when one of the chambers is expanding, the other chamber is being compressed. The mechanical linkage may take different forms, as discussed below.

The preferred embodiment of the pump operates by applying a linear force to a center element connected to the two forcing members. This compresses the bellows of one pump chamber and expands the bellows of the other pump chamber. In an inkjet recirculation system (as discussed with respect to FIG. 5, below), the pressure in the compressed bellows is raised to a value higher than the pressure in the pressurized ink supply and ink flows from the compressed bellows to the ink supply. The pressure in the expanded bellows is reduced to a subatmospheric value that is below the internal pressure of an inkjet pen (nominally 2 inches of water below atmospheric). When the pen reaches the end of each print swath, the direction of the force applied to the center element is reversed and the pressures in the two bellows are reversed Multiple check values in the interconnecting fluid lines are arranged so that either bellows will draw ink from the return line and push ink to the supply without cross-coupling.

Figure 3A:
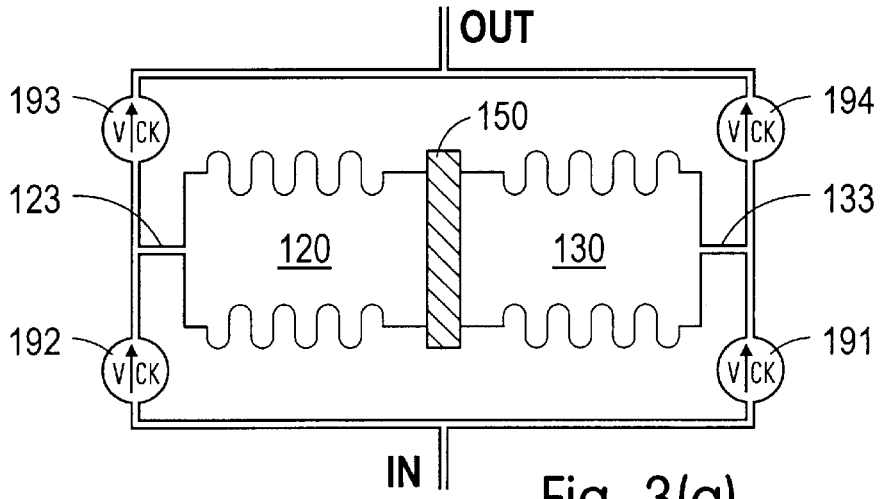
FIG. 3 schematically illustrates the operation of one embodiment of the pump of the present invention, with FIG. 3(*a*) depicting the pump in a static condition, FIG. 3(*b*) depicting the pump operation during one print swath, and FIG. 3(*c*) depicting the pump during the next successive print swath.
Figure 3B:
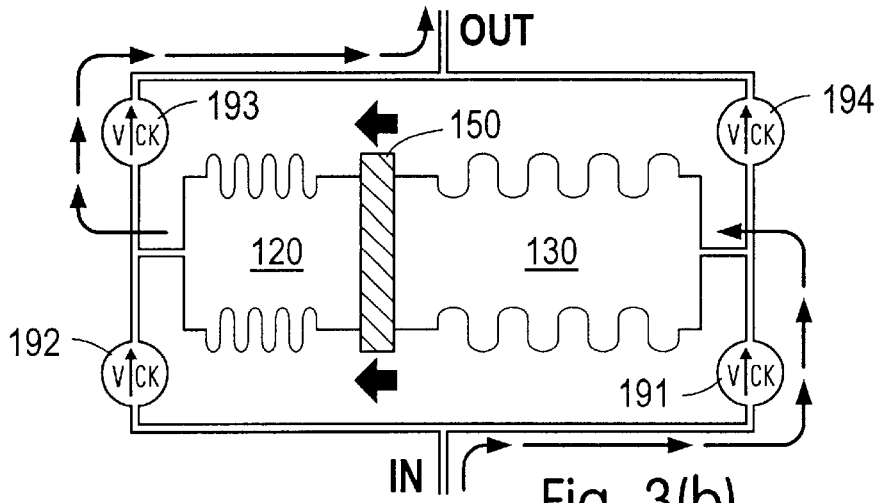
Figure 3C:
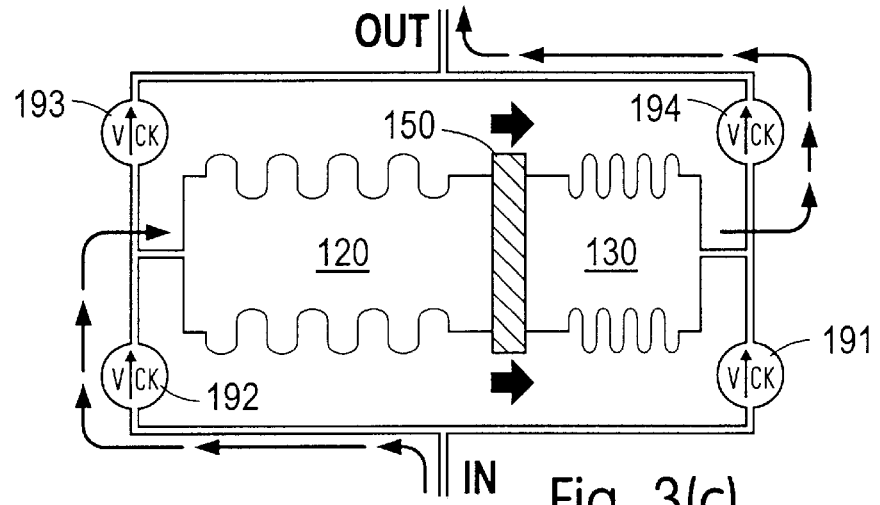

FIG. 3(*a*) illustrates a first embodiment of the present invention. The two expandable chambers 120, 130 each have a single fluid connection 123, 133 serving both as a fluid inlet and a fluid outlet. Mechanically coupled forcing members are provided by a single central member 150 which may be moved side-to-side, causing the two chambers to alternately expand or contract. Four check valves 191, 192, 193, 194 control the flow of fluid, such that fluid is drawn in at the IN port depicted at the bottom of the figure and expelled from the OUT port at the top of the figure.

FIGS. 3(*b*) and 3(*c*) illustrate the operation of the pump over one full cycle of operation. In an inkjet printer application, the cycle may correspond to the movement of the print carriage across print media, such that during one print swath the central member 150 travels in one direction, and then reverses direction when the carriage reverses direction.

In FIG. 3(*b*), the central member 150 is being forced to the left. The driving force for the central member may be provided by a solenoid (not shown), or any other common driving mechanism known in the art; in an inkjet printer, the driving member may alternatively be mechanically coupled to the mechanisms providing carriage motion. Fluid, such as ink, is drawn in the IN port and through check valve 191 into chamber 130. Fluid is expelled from chamber 120 through check valve 193, to the OUT port.

In FIG. 3(*c*), the central member 150 has reversed direction and is being forced to the right. Fluid is now drawn in the IN port and through check valve 192 into chamber 120; and fluid is expelled from chamber 130 through check valve 194 to the OUT port.

Figure 4:
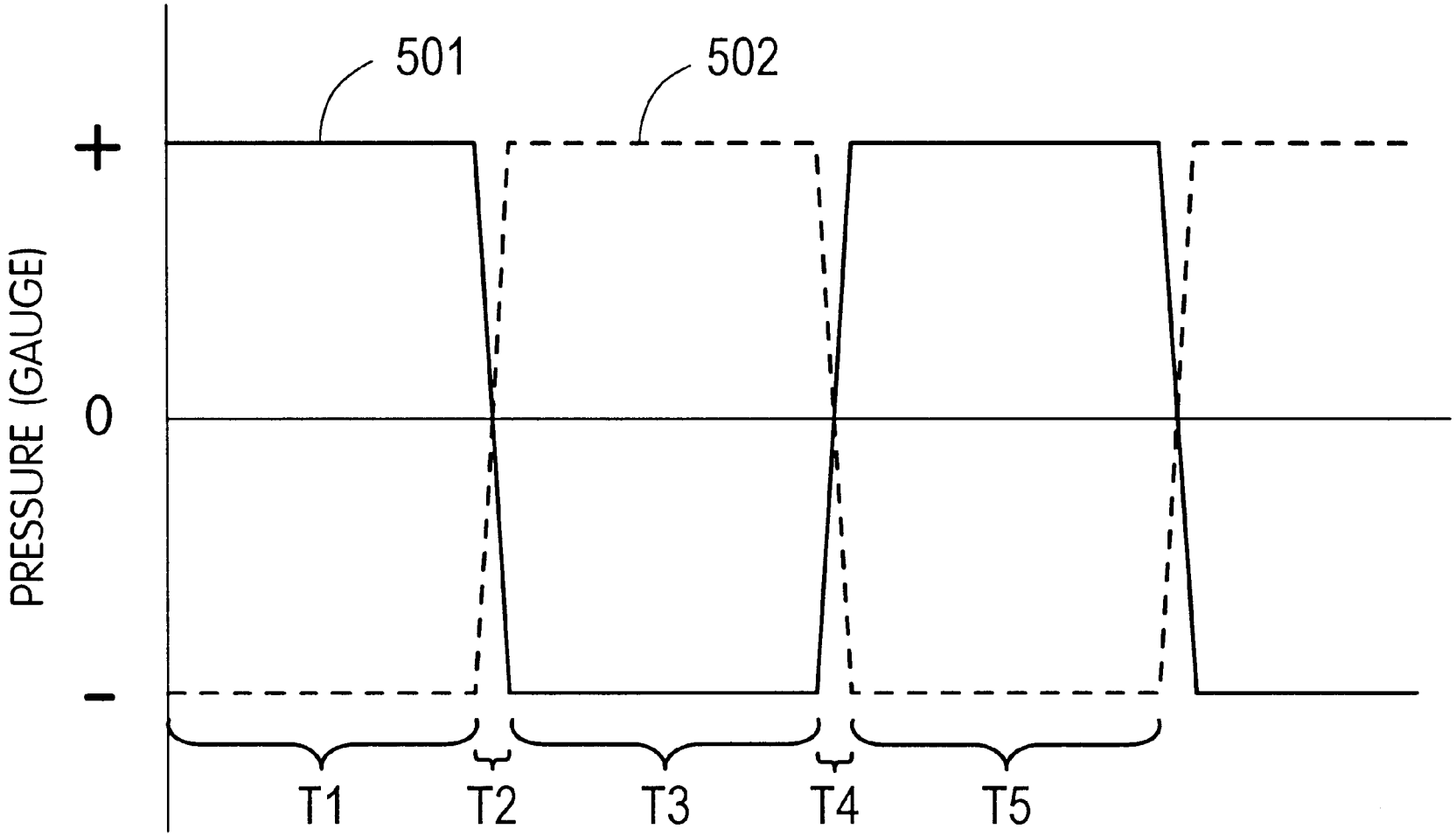
FIG. 4 is a timing diagram of one embodiment of the pump of the present invention, showing how a substantially constant pump pressure is maintained during the print swaths.

FIG. 4 further illustrates how the pump of the present invention can be utilized to provide a relatively constant fluid pressure in an inkjet printer application. Solid line 501 represents the pressure in chamber 120 (ref. FIG. 3), and dashed line 502 represents the pressure in chamber 130. Time period Ti corresponds to the situation illustrated in FIG. 3(*b*). As the central member 150 moves left, a positive pressure is maintained in chamber 120, and, via open check valve 193, at the OUT port. A negative is maintained in chamber 130 and, via open check valve 191, the IN port.

During a first print swath, as fluid is expelled from chamber 120 and is drawn into chamber 130, the central member moves to the left. At the completion of a print swath, the pump reverses direction, and during the next successive print swath the central member moves to the left, corresponding time period T3 and the situation illustrated in FIG. 3(*c*).

In an inkjet printer application, time period T2 of FIG. 4 corresponds to the "turn around" time of the printer carriage, during which the carriage is reversing direction and the media in the printer is being advanced. The present invention thus takes advantage of the short time interval between print swaths to reverse the motion of the central member.

Figure 5:
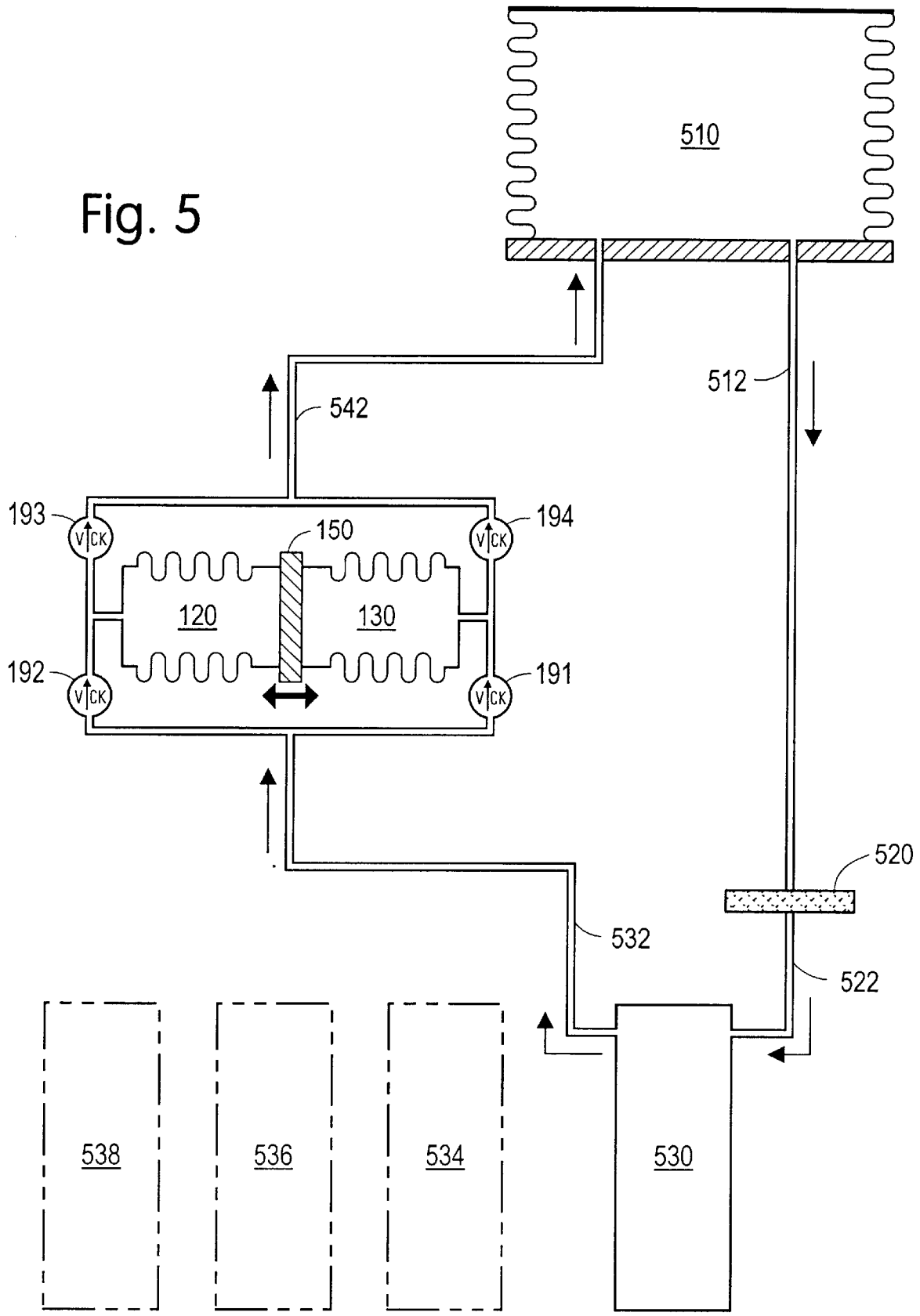
FIG. 5 is a schematic representation illustrating how the pump of the present invention may be utilized in an off-axis ink delivery system.

FIG. 5 illustrates how an embodiment of the present invention may be employed in an inkjet printer as part of an ink recirculation system. Although the pump embodiment of FIG. 3 is shown, any embodiment of the pump may be used, including the alternate embodiments described below. The system shown in FIG. 5 includes an off-axis ink supply 510, which may be pressurized to expel ink. Ink from the supply passes through tube 512 to filter 520. The filter is located near the printhead 530 and serves as the primary means of preventing air bubbles and particulate contaminants from reaching the printhead. It is known in the art, however, that the inkjet printing process itself can cause the accumulation of contaminants in a printhead (both particulates and air bubbles) due to the localized extreme heating of the ink. Recirculation systems, as illustrated in FIG. 5, are one technique used to remove these contaminants from the printheads.

Ink from the filter 520 passes through tube 522 to printhead 530. Additional printheads 534, 536, 538 are shown in phantom to indicate that the recirculation system shown in FIG. 5 may be duplicated in a printer for multiple ink supplies and printheads, such as for multiple ink colors. From the printhead the ink passes through tube 532 to the pump of the present invention, carrying contaminants out of the printhead.

In the embodiment of the present invention illustrated in FIG. 5, the central member 150 alternately moves to the right and left during alternate print scans, reversing direction during the carriage turn-around time at the end of each print scan. The expandable chambers 120 and 130 are sized to accept the total amount of ink that may be recirculated during a print scan. From the pump, the ink passes through tube 542 back to the ink supply.

Although FIG. 5 shows an ink circulation configuration from an "off-axis" supply to a carriage mounted printhead, the pump of the present invention may also be used in other applications. In printer applications, for example, the pump may be utilized to circulate ink within a print cartridge containing both the ink supply and printhead. The pump is also suitable to any application requiring a compact pump where the periodic characteristics of the pump output are acceptable.

Figure 6A:
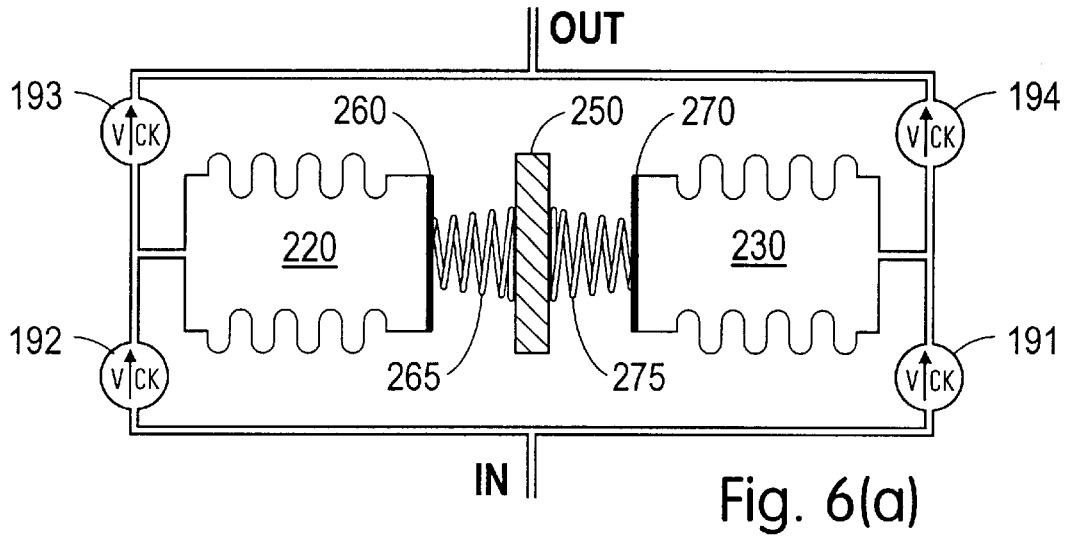
FIG. 6 schematically illustrates a second embodiment of the present invention, with FIG. 6(*a*) depicting the pump in a static condition, FIG. 6(*b*) depicting the pump operation during one print swath, and FIG. 6(*c*) depicting the pump during the next successive print swath.
Figure 6B:
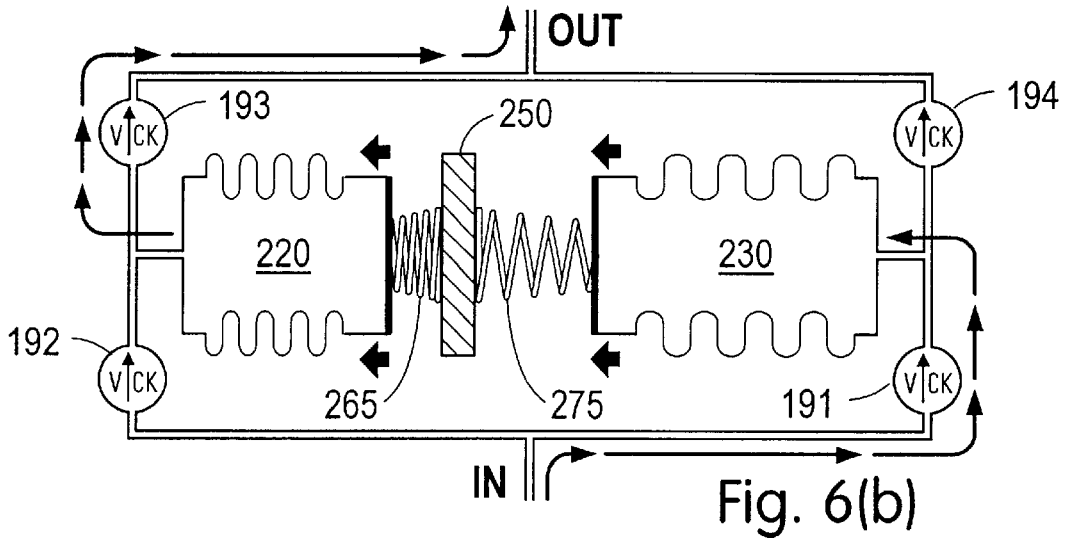
Figure 6C:
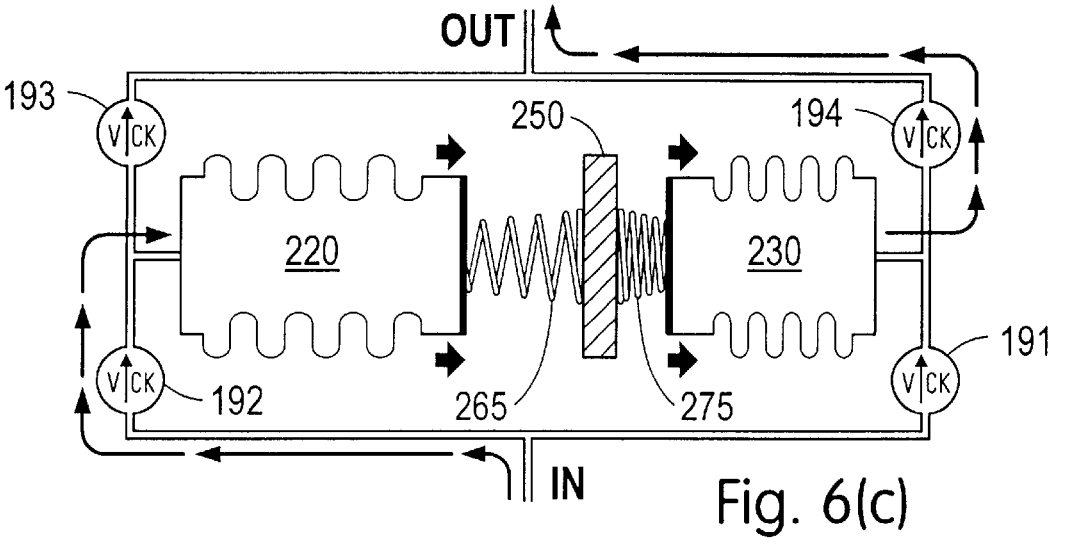
Figure 7A:
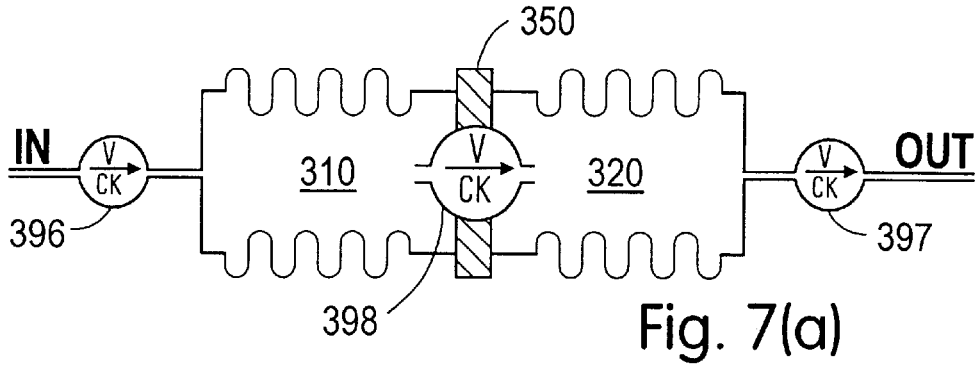
FIG. 7 illustrates a third embodiment of the pump of the present invention, with FIG. 7(*a*) depicting the pump in a static condition, FIG. 7(*b*) depicting the pump operation during a print swath, FIG. 7(*c*) depicting the pump operation during the turnaround time between print swaths, and FIG. 7(*d*) depicting the pump operation during the next successive print swath.
Figure 7B:
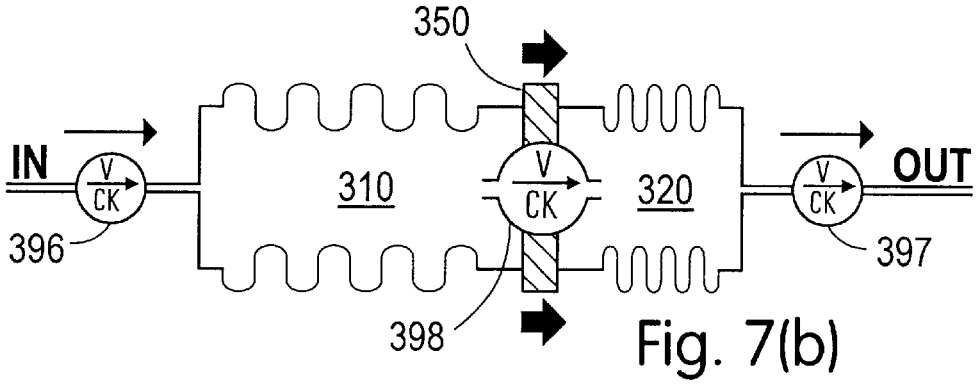
Figure 7C:
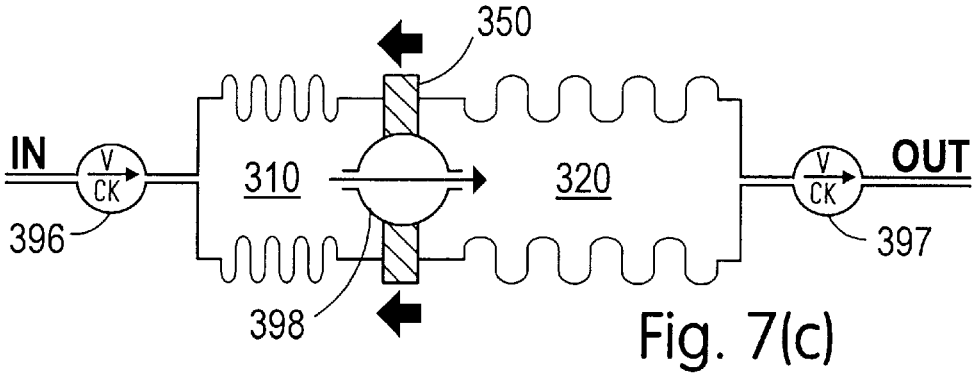
Figure 7D:
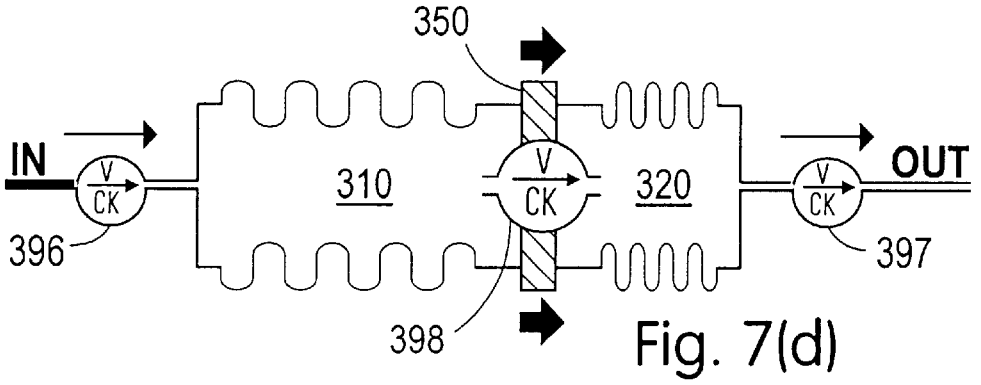

FIG. 6 illustrates an alternative embodiment of the pump. In the embodiment of FIG. 6, the forcing members 260, 270 of the two pump chambers 220, 230 are coupled to a central member 250 with springs 265, 275. This configuration allows the forcing member to be driven between two set positions in an "on/off" or "bang/bang" manner. Thus a simpler two-position driving mechanism (not shown) may be used to activate the pump, rather than the linear driving mechanism required by the embodiment shown in FIG. 3.

FIGS. 6(*b*) and 6(*c*) illustrate the alternate embodiment in its two drive positions. In FIG. 6(*b*), the central member 250 is in a leftward position; spring 265 is under compression, thus compressing chamber 220, and spring 275 is under tension, thus causing chamber 230 to expand. During the carriage turnaround time between print swaths, the central member is driven to the its opposite position. In FIG. 6(*c*), the central member 250 is in a rightward position; spring 265 is in tension, causing chamber 220 to expand, and spring 275 is under compression, thus compressing chamber 230.

FIG. 7 illustrates a third embodiment of the pump, wherein an oversized check valve 398 in incorporated into the central member 350 separating the two chambers 310, 320. In this pump, the left chamber 310 always serves as an input chamber, and the right chamber 320 always serves as an output chamber. During a print swath (FIG. 7(*a*)), the central member 350 always moves to the right, and check valve 398 is thus closed. Fluid is drawn into chamber 310 via check valve 396, and expelled out of chamber 320 via check valve 397.

During the short turnaround time between print swaths (FIG. 7(*b*)), the central member reverses, and the fluid accumulated in the left chamber 310 is transferred to the right chamber 320 through the oversized check valve 398 (check valves 396 and 397 are closed). The transfer of fluid from the left to right chamber is completed before the commencement the next print swath, and the central member again reverses and moves to the right.

Figure 8:
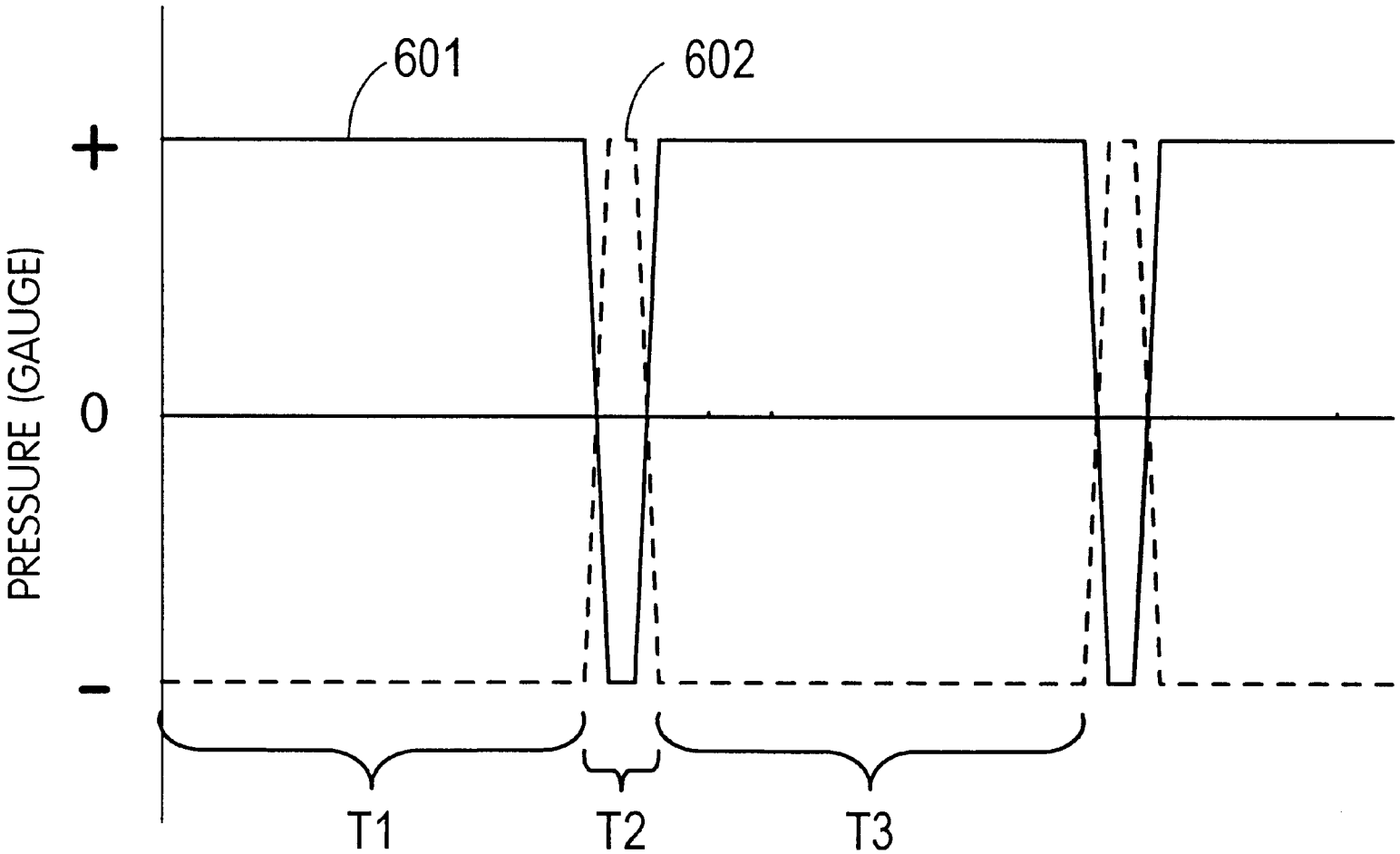
FIG. 8 is a timing diagram of the third embodiment of the pump of the present invention, showing how a substantially constant pump pressure is maintained during the print swaths.

FIG. 8 further illustrates the timing of third embodiment. Solid line 601 represents the pressure in the right chamber 320 and dashed line 602 represents the pressure in the left chamber 330. During a print swath, as indicated at T1, the central member moves to the right, drawing fluid into chamber 310 and expelling fluid from chamber 320. During the short carriage turnaround time at the end of a print swath, as indicated at T2, the central member reverses and fluid is transferred from the inlet chamber 310 to the outlet chamber 320 through oversized check valve 398. When the printer begins another print swath, as indicated at T3, the central member reverses direction and again travels to right, drawing fluid into chamber 310 and expelling it from chamber 320.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled. The corresponding structures, materials, acts, and equivalents of all means or step plus function elements in the claims below are intended to include any structure, material, or acts for performing the functions in combination with other claimed elements as specifically claimed.

What is claimed is:

1. A pump, comprising:

a) two expandable chambers, each chamber having
   (1) a fluid inlet,
   (2) a fluid outlet, and
   (3) a positive displacement member which draws fluid into the chamber through the fluid inlet by causing the chamber to expand, and expels fluid out of the chamber through the fluid outlet by causing the chamber to contract;

b) a plurality of check valves preventing retrograde motion of fluid in the pump; and wherein c) the positive displacement members of the two chambers are in mechanical communication, such that when one of the two chambers is expanding the other chamber is contracting; and d) at least one spring mechanically interposed between the positive displacement members.

2. A fluid pump, comprising:

a) a fluid inlet;

b) a fluid outlet;

c) a first expandable chamber and a second expandable chamber, each expandable chamber having a fluid opening and a pressurizing wall which draws fluid into the chamber through the fluid opening by causing the chamber to expand, and expels fluid out of the chamber through the fluid opening by causing the chamber to contract;

d) fluidic connections from the fluid inlet to the each of the chamber fluid opening, and from each of the chamber fluid openings to the fluid outlet the fluidic connections having check valves; and wherein e) the pressurizing walls of the first and second expandable chambers are in mechanical communication, such that when one of the two chambers is expanding the other chamber is contracting, and f) at least one spring mechanically Interposed between the two pressurizing walls.

3. A system having a repeating operating cycle with an active period followed by a quiescent period, a fluid pump for providing substantially constant pressure during the active period, comprising:

a) two expandable chambers, each chamber having
(1) a fluid inlet,
(2) a fluid outlet, and
(3) a positive displacement member which draws fluid into the chamber through the fluid inlet by causing the chamber to expand, and expels fluid out of the chamber through the fluid outlet by causing the chamber to contract;

b) a plurality of check valves preventing retrograde motion of fluid in the pump;

c) the positive displacement members of the two chambers in mechanical communication, such that when one of the two chambers is expanding the other chamber is contracting;

d) wherein throughout the duration of an active period of the system one chamber is in continuous expansion and the other chamber is in continuous contraction; and e) wherein the system having a repeating operating cycle comprises a printer with a scanning print carriage which prints sequential print swaths on print media with a carriage turnaround time between print swaths, and wherein the active period comprises a print swath of the printer and the quiescent period comprises the carriage turnaround time.

4. An inkjet printing system having a scan carriage with a printhead and an ink supply remotely located from the scan carriage, the printing system configured to sequentially print swaths on print media with a carriage turnaround time between print swaths, the printing system further having and an ink delivery system which circulates ink from the ink supply to the printhead and returns a portion of the ink from the printhead to the ink supply, a pump, comprising:

a) two expandable chambers, each chamber having
(1) a fluid inlet,
(2) a fluid outlet, and
(3) a positive displacement member which draws fluid into the chamber through the fluid inlet by causing the chamber to expand, and expels fluid out of the chamber through the fluid outlet by causing the chamber to contract;

b) a plurality of check valves preventing retrograde motion of fluid in the pump;

c) the positive displacement members of the two chambers in mechanical communication, such that when one of the two chambers is expanding the other chamber is contracting; and wherein d) throughout the duration of a print swath one chamber is in continuous expansion and the other chamber is in continuous contraction.

5. The fluid pump of claim 4, wherein during the carriage turnaround time the chamber that had been in contraction during the preceding print swath is placed in expansion, and the chamber that had been in expansion during the preceding print swath is placed in contraction.

6. The fluid pump of claim 4, wherein during the carriage turnaround time the fluid accumulated in the chamber that had been in expansion during the preceding print swath is transferred to the chamber that had been under compression during the preceding print swath.

7. The fluid pump of claim 6, wherein the fluid transfer is accomplished by placing the chamber which had been under expansion during the preceding system active period under compression, and placing the chamber which had been under compression during the preceding system active period under expansion, the fluid transfer occurring through a check valve in fluid communication with the two chambers.

8. The pump of claim 7, wherein the positive displacement members of the two chambers are formed on opposite sides of a single driving member.

9. The pump of claim 8, wherein the single driving member further comprises the check valve in fluid communication with the two chambers through which the fluid transfer occurs.

10. A method of providing substantially constant pressure during a print swath in a printer ink circulation system, the printer configured to sequentially print swaths on print media with a carriage turnaround time between print swaths, comprising:

a) providing two expandable chambers, each chamber configured to accumulate ink from one part the ink circulation system by expanding, and to expel ink into another part of the ink delivery system by contracting;

b) during a print swath, accumulating ink in one of the expandable chambers and expelling it from the other expandable chamber; and c) during the carriage turnaround time between print swaths, transposing the functions of the two chambers, such that the chamber that had been accumulating ink during the preceding print swath expels ink, and the chamber that had been expelling ink during the preceding print swath accumulates ink.

11. A method of providing substantially constant pressure during a print swath in a printer ink circulation system, the printer configured to sequentially print swaths on print media with a carriage turnaround time between print swaths, comprising:

a) providing two expandable chambers, each chamber configured to accumulate ink from one part the ink circulation system by expanding, and to expel ink into another part of the ink delivery system by contracting;

b) during a print swath, accumulating ink in one of the expandable chambers and expelling it from the other expandable chamber; and c) during the carriage turnaround time between print swaths, transferring ink from the chamber which had been accumulating ink during the preceding print swath into the chamber that had been expelling ink during the preceding print swath.

* * * * *